United States Patent [19]

Nomura et al.

[11] 3,980,065

[45] Sept. 14, 1976

[54] AUTOMATIC ACTUATOR FOR CARBURETOR CHOKE VALVE

[75] Inventors: Toshio Nomura, Niiza; Masaaki Ozaki, Sayama; Makoto Ishii, Wako; Masahiko Iiyama, Tokyo, all of Japan

[73] Assignee: Honda Giken Kogyo Kabushiki Kaisha, Tokyo, Japan

[22] Filed: Apr. 4, 1975

[21] Appl. No.: 565,082

[30] Foreign Application Priority Data

Apr. 10, 1974 Japan ..... 49-41316
Apr. 15, 1974 Japan ..... 49-40936

[52] U.S. Cl. ..... 123/119 F; 261/39 E

[51] Int. Cl.[2] ..... F02D 11/08; F02N 1/10; F02N 23/04

[58] Field of Search ..... 261/39 E, 39 R, 119 F; 123/119 F

[56] References Cited

UNITED STATES PATENTS

| | | | |
|---|---|---|---|
| 2,481,259 | 9/1949 | Taylor | 123/119 F |
| 2,867,424 | 1/1969 | Sutton | 261/39 E |
| 3,161,787 | 12/1964 | Van Saan | 123/119 F |
| 3,179,098 | 4/1965 | Highley et al. | 261/39 E |
| 3,806,854 | 4/1974 | Armstrong | 123/119 F |
| 3,898,967 | 8/1975 | Bennett | 123/119 F |

*Primary Examiner*—Wendell E. Burns
*Attorney, Agent, or Firm*—Lyon & Lyon

[57] ABSTRACT

An automatic actuator for a carburetor choke valve of the type having a case supporting a heat and electrically conductive shaft therein and attached to said shaft a temperature responsive choke valve operating means, a heater for actuating said choke valve operating means, and a heat sensing means for sensing heat from said heater and for controlling current to said heater.

12 Claims, 3 Drawing Figures

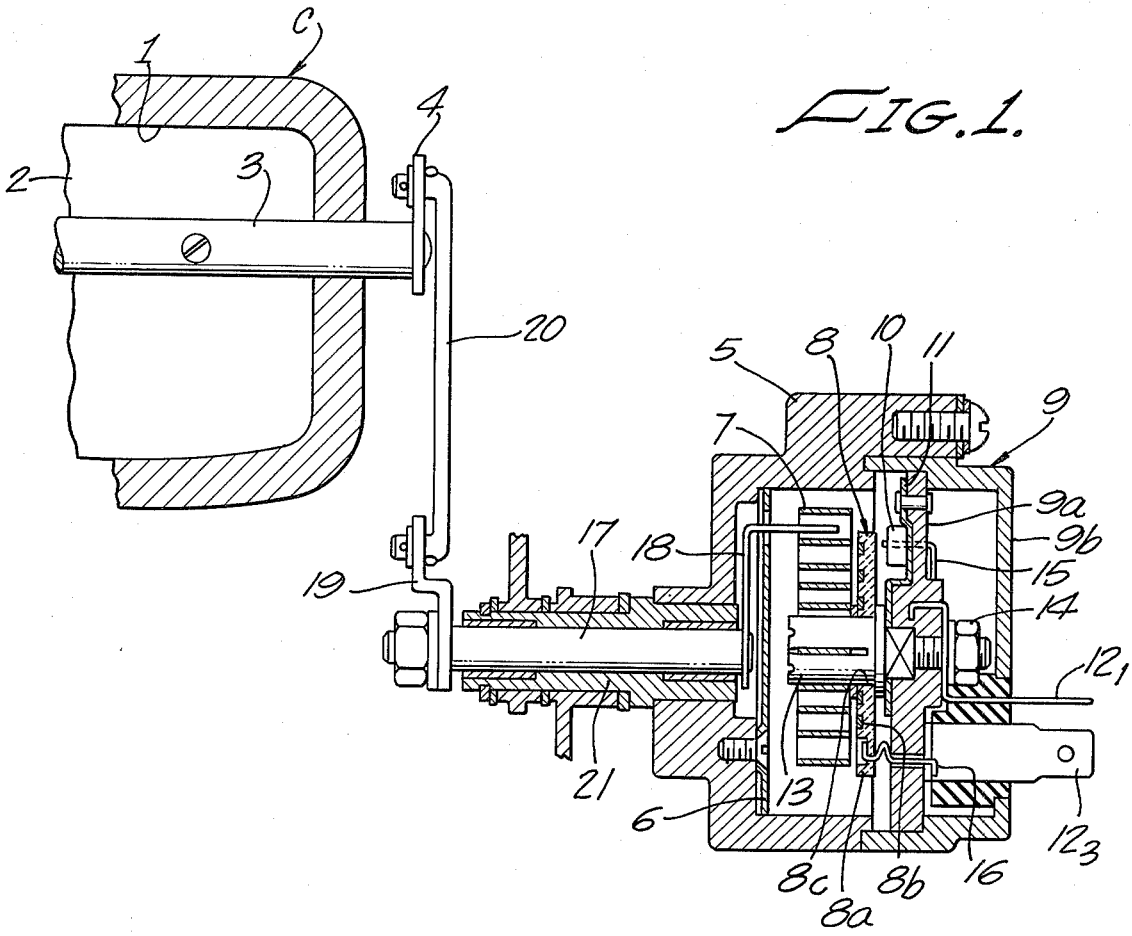
FIG. 1.
FIG. 2.
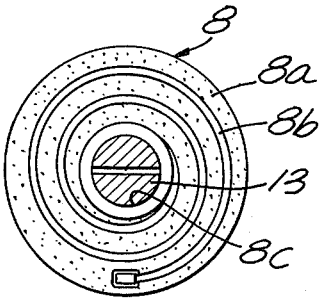
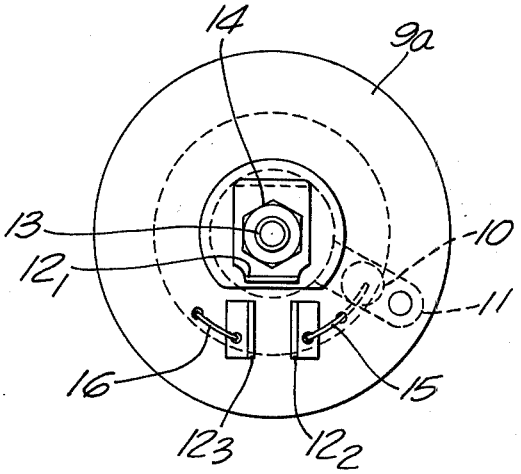
FIG. 3.

AUTOMATIC ACTUATOR FOR CARBURETOR CHOKE VALVE

BACKGROUND OF INVENTION

Automatic actuators for carburetor choke valves of the type having a heating panel which heats a bimetal mechanically associated with the choke valve of a carburetor for automatically adjusting the position of the choke valve by thermal strain of the bimetal are commonly used on internal combustion engines. These devices normally have a temperature sensor encased along with the heating panel and bimetal in a housing, said temperature sensor sensing the temperature of the bimetal and regulating the current to the heating panel so as to attempt to maintain the temperature of the bimetal beneath a certain temperature for prevention of excessive thermal deformation of the bimetal.

However, with devices of conventional structure, there are disadvantages in that the temperature sensor only receives radiant heat from the heating panel resulting in delayed sensing of the bimetal temperature, which can cause the bimetal and other parts of the actuator to overheat and suffer thermal damage.

SUMMARY OF THE INVENTION

The present invention contemplates an automatic actuator for a carburetor choke valve of the type having a heating panel, a bimetal mechanically associated with the choke valve which automatically adjusts the position of the choke valve dependent upon heat produced by the heating panel, and a heat sensor for sensing the temperature of the bimetal and regulating the current to the heating panel such that the problem of excessive deformation to the bimetal or other parts of the actuator caused by heat from the heating panel is obviated.

It is, therefore, an object of the instant invention to prevent thermal damage to automatic choke valve actuators by constructing such actuators so as to be highly responsive to their operating temperature.

Another object of the instant invention is to provide an automatic choke valve actuator of simplified structure so as to, among other things, allow for easier assembly.

Still another object of the present invention is to provide a heating panel for an automatic choke valve actuator of simplified structure and enhanced durability so as to allow respectively for construction of a smaller actuator and so as not to crack or be damaged due to thermal expansion.

Many other features, advantages and additional objects of the present invention will become manifest to those versed in the art upon making reference to the detailed description which follows and the accompanying sheets of drawings, in which preferred structural embodiments incorporating the principles of the present invention are shown by way of illustration only.

BRIEF DESCRIPTION OF THE DRAWINGS

In the drawings:

FIG. 1 is a cross-sectional side view of a preferred embodiment of this invention.

FIG. 2 is a front view of a heating panel in accordance with the principles of the present invention.

FIG. 3 is a rear view of an inner cover as found in the preferred embodiment.

Referring to the drawings, C is a conventional carburetor connected to an intake passage 1, and in the intake passage 1, a choke valve 2 is supported by a valve stem 3 so as to be operated by movement of a choke lever 4 fixed to the valve stem 3.

Adjacent to said carburetor C, a case 5 is provided which houses a reflecting plate 6 fixed to the side of the case 5 which is nearest the carburetor and perpendicular to the longitudinal axis of the valve stem 3 of the carburetor C, as well as a spiral bimetal 7 and a heating panel 8, with a cover 9, having an inner wall **9*a* and outer wall 9*b*, fitted into an opening in the case 5 at the side opposite from the reflecting plate 6**.

To the side of the inner wall **9*a* facing the reflective plate 6 is fixed a bracket 11 that is made of heat and electrically conductive material and supports a temperature sensor 10. Within the cover 9 are buried the base ends of three terminals $\mathbf{12_1}$, $\mathbf{12_2}$ and $\mathbf{12_3}$ which protrude outside the cover 9 through the outer wall 9*b* and are connected to an electrical circuit not shown. Also, a stationary shaft 13 is installed through the center of the inner wall 9*a* and the respective base ends of the first terminal $\mathbf{12_1}$ and the bracket 11, which also serves as a washer, with a nut 14 screwed on its one end nearest the outer wall 9*b*. Hence, the shaft 13 is fixed to the inner wall 9*a* and also forms an electrical path between the bracket 11** and the first terminal $\mathbf{12_1}$.

The temperature sensor 10 supported by the bracket 11 is capable of sensing the temperature of the bimetal 7 to prevent it from being overheated by limiting current to the heating panel 8, and may be composed, for instance, of a resistor with resistance that varies with changes in temperature, one of its terminals being connected directly to the bracket 11 and the other connected to the second terminal $\mathbf{12_2}$ through a conductor 15.

Said heating panel 8, having a central opening **8*c* to receive said shaft 13, is firmly attached to the shaft 13 and in a position opposing the bimetal 7, which is also firmly attached to the shaft 13 by its inner end or base end, with a clearance between them. The heating panel 8 is composed of a circular ceramic plate 8*a* as its main body with a heating wire 8*b* printed spirally on the face thereof, the inner end of the heating wire 8*b* brazed to the shaft 13 and the outer end connected to the third terminal $\mathbf{12_3}$ through a conductor 16. Therefore, the shaft 13 forms another electrical path between the heating wire 8*b*** and the first terminal $\mathbf{12_1}$.

Coaxially with said stationary shaft 13, a shaft 17 is mounted to turn in a sleeve 21 fixed to the side wall of the case 5 opposite the cover 9, and an operating lever 18 fixed to the inner end thereof is connected to the outer end or free end of said bimetal 7 and a driving lever 19 fixed to the outer end thereof is connected to said choke lever 4 through a connecting rod 20.

In operation this preferred embodiment functions as follows:

When the engine is not in motion, the temperature in the case 5 is in equilibrium with the engine ambient temperature. If the engine ambient temperature is relatively low, the bimetal 7 contracts to produce a valve closing torque, which is transmitted through the operating lever 18, the driving lever 19, etc. to the choke lever 4 to hold the choke valve 2 closed for starting. In this condition when the engine is cranked, a rich mixture suitable for starting is supplied from the carburetor C to the engine, which starts immediately.

As the engine is started, the heating panel 8 is energized and the bimetal 7 is heated efficiently by radiant heat from the heating panel 8 and by heat conducted through the shaft 13 to start expanding and produce a valve opening torque by which the operating lever 18, etc. are made to turn so as to open the choke valve 2. Thereby, the mixture produced in the carburetor C is made gradually leaner to enable the engine to perform a stable warm-up.

When the bimetal 7 is heated sufficiently and the choke valve 2 is opened fully, the temperature sensor 10 senses such conditions accurately by receiving radiant heat from the heating panel 8 and heat conducted through the shaft 13 and the bracket 11 and limits current to the heating panel 8, so that the temperature of the bimetal 7 is adjusted so as to protect the bimetal 7 and other parts of the actuator from thermal damage.

Therefore, in accordance with the invention as described above, the shaft 13 and the bracket 11 are able to perform the roles of both heat conduction members and electrical conduction members from the heating panel 8 to the bimetal 7 and temperature sensor 10, so that the bimetal 7 and temperature sensor 10 are heated efficiently not only by radiant heat from the heating panel 8, but also by heat conducted through the shaft 13 and bracket 11; thus, it is possible to achieve effects such that the choke valve 2 can be adjusted accurately, the temperature sensor 10 can regulate current to the heating panel 8 with minimal delay, the bimetal 7 and other parts of the actuator can be protected from excessive deformation and thermal damage, the electrical wiring can be simplified, the structure can be simplified, and assembly can be made easier.

Furthermore, since the heating panel 8 is not attached to the shaft 13 by any parts other than the central opening 8*c*, this substantially prevents it from cracking or being damaged due to thermal expansion, giving it superior durability. Also, since the heating panel 8 is composed of the ceramic plate 8*a* with the heating wire 8*b* printed on the face thereof, it is not only far simpler to construct, as compared with those of conventional type, but enables the heating panel 8 to be made thinner and, therefore, the whole device smaller.

Having fully described our invention, it is to be understood that we are not to be limited to the details herein set forth, but that our invention is of the full scope of the appended claims.

We claim:

1. In an internal combustion engine carburetion system having a carburetor including an air intake passageway and a choke valve, the improvement of an automatic actuator for the carburetor choke valve comprising: a shaft comprised of heat conductive material fixed relative to said carburetor, temperature responsive choke valve operating means attached to said shaft for actuating said choke valve, a heater attached to said shaft for heating said choke valve operating means, and heat sensing means attached to said shaft for sensing heat from said choke valve operating means and for regulating current to said heater; said choke valve operating means, heater and heat sensing means being thermally associated with said heat conductive shaft.

2. In an internal combustion engine carburetion system having a carburetor including an air intake passageway and a choke valve, the improvement of an automatic actuator for the carburetor choke valve comprising: a shaft comprised of electrically conductive material fixed relative to said carburetor, temperature responsive choke valve operating means attached to said shaft for actuating said choke valve, a heater attached to said shaft for heating said choke valve operating means, and heat sensing means attached to said shaft for sensing heat from said choke valve operating means and for regulating current to said heater; said heater and heat sensing means being electrically associated with said electrically conductive shaft.

3. In an internal combustion engine carburetion system having a carburetor including an air intake passageway and a choke valve, the improvement of an automatic actuator for the carburetor choke valve comprising: a shaft comprised of heat and electrically conductive material fixed relative to said carburetor, temperature responsive choke valve operating means attached to said shaft for actuating said choke valve, a heater attached to said shaft for heating said choke valve operating means, and heat sensing means attached to said shaft for sensing heat from said choke valve operating means and for regulating current to said heater; said choke valve operating means, heater, and heat sensing means being thermally associated with said heat and electrically conductive shaft; and said heater and heat sensing means being electrically associated with said heat and electrically conductive shaft.

4. The apparatus as defined in claim 1 wherein said heater is comprised of a circular ceramic plate with a heating wire printed spirally on the face of said ceramic plate, said ceramic plate having a central opening to receive said shaft.

5. The apparatus as defined in claim 1 wherein said choke valve operating means is comprised of a spiral bimetal connected to said shaft and mechanically associated with said choke valve.

6. The apparatus as defined in claim 1 wherein said heat sensing means is comprised of a heat and electrically conductive bracket with its base end connected to said shaft and supporting a temperature sensor.

7. The apparatus as defined in claim 2 wherein said heater is comprised of a circular ceramic plate with a heating wire printed spirally on the face of said ceramic plate, said ceramic plate having a central opening to receive said shaft.

8. The apparatus as defined in claim 2 wherein said choke valve operating means is comprised of a spiral bimetal connected to said shaft and mechanically associated with said choke valve.

9. The apparatus as defined in claim 2 wherein said heat sensing means is comprised of a heat and electrically conductive bracket with its base end connected to said shaft and supporting a temperature sensor.

10. The apparatus as defined in claim 3 wherein said heater is comprised of a circular ceramic plate with a heating wire printed spirally on the face of said ceramic plate, said ceramic plate having a central opening to receive said shaft.

11. The apparatus as defined in claim 3 wherein said choke valve operating means is comprised of a spiral bimetal connected to said shaft and mechanically associated with said choke valve.

12. The apparatus as defined in claim 3 wherein said heat sensing means is comprised of a heat and electrically conductive bracket with its base end connected to said shaft and supporting a temperature sensor.

* * * * *